United States Patent [19]

Martin, Jr.

[11] Patent Number: 4,574,727

[45] Date of Patent: Mar. 11, 1986

[54] BOOKMARK

[76] Inventor: Robert P. Martin, Jr., c/o Martin Sheet Metal, Inc. 7108 Madison Ave., Cleveland, Ohio 44102

[21] Appl. No.: 522,028

[22] Filed: Aug. 11, 1983

[51] Int. Cl.[4] ..... B42D 9/00

[52] U.S. Cl. ..... 116/234; 116/239; 281/42; 428/40

[58] Field of Search ..... 116/234–240; 281/42; 428/40, 41; 604/389, 390; 40/2 R

[56] References Cited

U.S. PATENT DOCUMENTS

| | | | |
|---|---|---|---|
| 2,394,372 | 2/1946 | Evans | 116/238 |
| 2,682,266 | 6/1954 | Freiberger | 128/156 |
| 3,055,680 | 9/1962 | Stoffel | 116/234 |
| 3,535,804 | 10/1970 | Cunningham | 40/2 R |
| 4,285,999 | 8/1981 | Olivieri et al. | 428/40 |
| 4,288,877 | 9/1981 | Klepfer | 428/40 |
| 4,302,513 | 11/1981 | Russell | 428/40 |

FOREIGN PATENT DOCUMENTS

| | | | |
|---|---|---|---|
| 967746 | 5/1975 | Canada | 40/2 R |
| 56-02867 | 10/1981 | Japan | 116/239 |
| 379459 | 9/1932 | United Kingdom | 281/42 |

*Primary Examiner*—Charles Frankfort
*Assistant Examiner*—W. Morris Worth
*Attorney, Agent, or Firm*—Pearne, Gordon, Session, McCoy, Granger & Tilberry

[57] ABSTRACT

A user installed bookmark formed as an assembly of a flat anchor and an elongate flexible marker. The anchor is provided with a pressure sensitive adhesive which serves at an integral tail portion to retain the marker and, when exposed by removing a backing layer, serves to fix the assembly to a book. The release backing includes a convenient pull tab donated from a tail portion of an anchor when these elements are blanked from sheet stock.

6 Claims, 4 Drawing Figures

BOOKMARK

BACKGROUND OF THE INVENTION

This invention relates generally to bookmarks, and more particularly to a novel and improved design and method of construction which may be used for the economic and efficient manufacture of user applied bookmarks.

SUMMARY OF THE INVENTION

In accordance with the present invention, there is provided an adhesive anchored bookmark and a method of manufacturing it. The bookmark of the present invention may be fabricated at a low cost by using pressure sensitive adhesive backed sheet stock for an anchor body assembled with an elongate flexible marker. With the pressure sensitive adhesive bookmark article is conveniently secured by a user within a book without damaging the book or its binding. The article is further designed to provide a secure flexible marker which will not deform the pages, or provide extra height or width when the book is closed.

The anchor body is supplied with a release backing that has a tab which extends beyond the anchor body to provide easy removal of the release backing by simply peeling it away from the anchor body. A tail integrally formed with the anchor body secures the flexible marking means on opposite sides by means of the pressure sensitive adhesive.

A method of manufacture is provided whereby the anchor body element of the bookmark is blanked from sheet stock material coated with a pressure sensitive adhesive and having a co-extensive release backing. The anchor sheet stock and release backing are cut so as to allow a minimum amount of waste and to simplify the construction of the bookmark. Preferably, the method allows the release tab of the release backing to be donated from the tail portion of an adjacent lying anchor body.

DETAILED DESCRIPTION OF THE DRAWING

Figure 1:
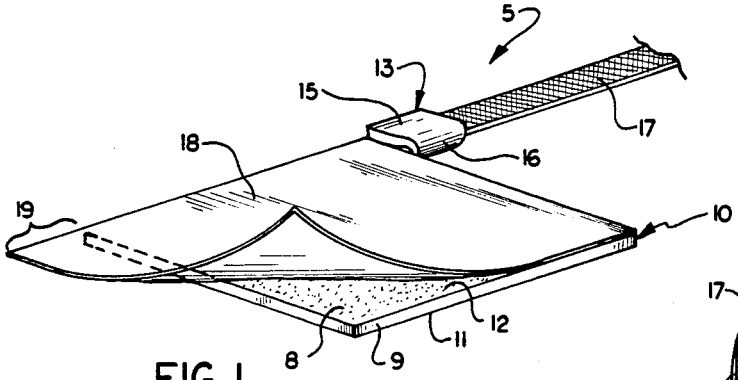
FIG. 1 is a perspective view of the bookmark, with the release backing partially peeled away, construed in accordance with the invention.

In accordance with this invention, a bookmark 5 includes an anchor 10 having a front face 11 and a back face 12. Ideally, the front face 11 has the appearance of velvet, suede, or some similarly luxurious material. The back face 12 is treated with a pressure sensitive adhesive 8. Preferably, a main body portion 9 of the anchor 10 is flat and square with sides approximately one inch long.

The bookmark anchor 10 also includes a marker tail 13 integral with the main body 9 at one of the corners of the body. The marker tail 13 is cut from the same material as the anchor body 9 and consists of two leaves 14 and 15. The marker tail 13 is treated with the same pressure sensitive adhesive 8 with which the body 9 is treated.

The marker tail 13 is connected to the body 9 of the anchor 10 through the leaf 14, which is a continuous integral extension of the body. Leaf 15 is a continuous extension from the side of leaf 14 adjacent to the side of leaf 14 connected to the body 9. In the blank form of FIG. 3, the leaf 15 is adjacent but not directly connected to the body 9 of the anchor 10. Leaf 15 is formed by cutting the marker tail 13 from the body 9 of the anchor 10 on a line 24 to a fold line 16.

The bookmark also includes a marker 17 which consists of a long, slender, flexible, element such as a flat ribbon which may be about $\frac{3}{8}$ inch wide and nine inches long. The marker 17 may be made of velvet or of grosgrain or of similar material which has a high coefficient of friction.

One flat side of the marker 17 is affixed to the pressure sensitive adhesive 8 of leaf 14, and the marker tail 13 is folded about the fold line 16 so that the other leaf 15 secures the other flat side of the marker. The marker tail 13 may extend from either corner of the body 9 of the anchor 10 depending on whether the bookmark is to be used on the inside front cover or inside back cover of the book.

The bookmark also includes a release backing 18 which is releasably retained on the adhesive 8 on the back face 12 of the anchor 10. The release backing 18 protects the pressure sensitive adhesive 8 until the bookmark is to be secured to the book. The release backing 18 includes an integral release tab 19 which extends away from the body 9 of the anchor 10 at a side opposite to the marker tail 13. The release tab 19 facilitates the easy removal of the release backing 18 when the user applies the bookmark to the book.

Figure 2:
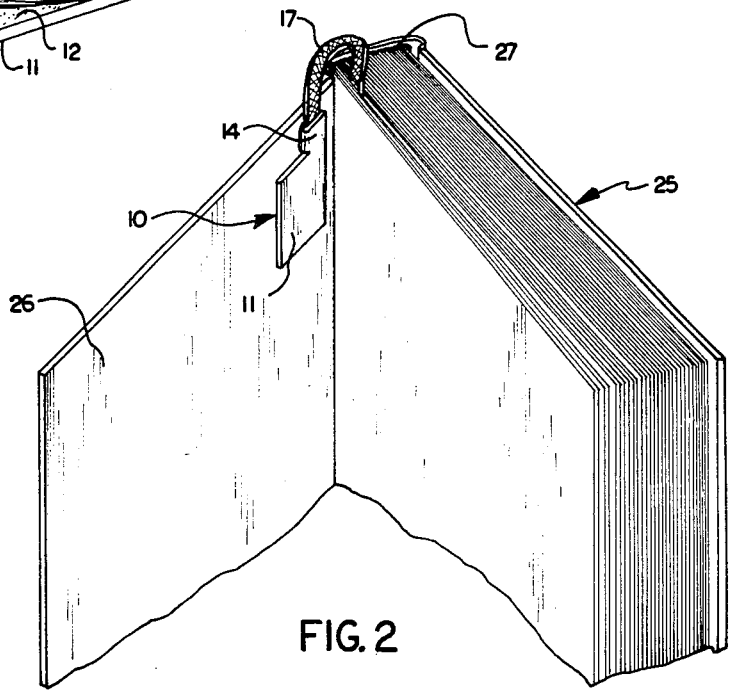
FIG. 2 is a perspective view of the bookmark secured to the inside cover of a book.

The release backing 18 covers the full area of the back face 12 of the anchor body 9. The release tab 19 of the release backing preferably extends beyond the anchor body 9 a distance which is equal to the length of the marker tail 13. The release tab 19 in the embodiment of FIGS. 1–3 extends across the entire width of the body 9.

To use the bookmark 5, the release backing 18 is manually removed from the body 9 by pulling the release tab 19 away from the body and peeling the backing completely from the bookmark. The back face 12 of the anchor body 9, which is treated with the pressure sensitive adhesive 8, is then pressed against the insider cover 26 of a book 25 so that the marker 17 extends from the top of the book and so that the marker tail 13 is adjacent to a spine 27 of the book. The bookmark should be positioned so that only the marker 17 and not the marker tail 13 extends beyond the book cover 26. Therefore only the marker 17 can be seen above the top of the book 25 when the book is closed.

Once the bookmark 5 is in position on the inside cover 26 of the book, the marker 17 may be drawn to the place to be marked, and then laid between the pages to mark that place.

Figure 3:
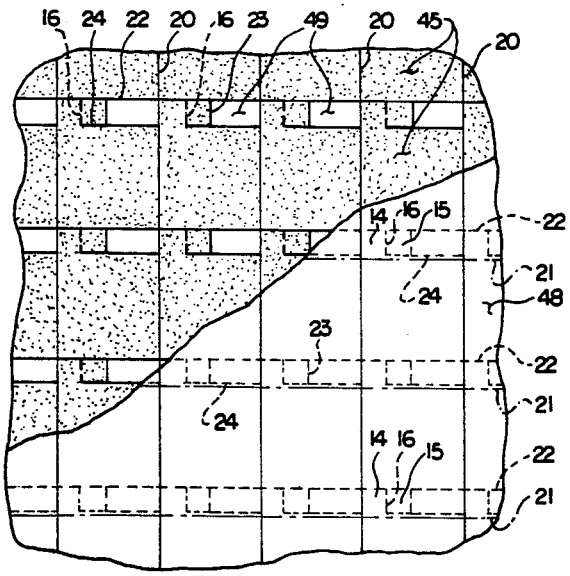
FIG. 3 is a view of a bookmark anchor blanked in sheet stock with the release backing material partially stripped away to illustrate a method of cutting the anchor sheet stock material and the release backing.

A method of manufacturing the bookmark 5 is depicted in FIG. 3. The anchor 10 and corresponding release backing 18 are cut from an imperforate laminated composite sheet or web of material, including an anchor sheet 45, from which are formed anchors 10, and backing material 48, from which the release backing 18 is formed, and pressure sensitive adhesive therebetween. The backing sheet 48 is paper or the like, and is treated with silicone, or a like compound to provide for easy release from the pressure sensitive adhesive 8.

The anchor sheet 45, and backing sheet 48 are cut by suitable dies or the hand, as is illustrated in FIG. 3. Both the anchor sheet 45 and the backing sheet 48 are cut along continuous longitudinal cuts 20. This forms the vertical sides of the bookmark. The backing sheet 48 is severed along continuous transverse cuts 21. This is shown in FIG. 3 by the dashed lines 21. The anchor sheet 45 is cut along continuous transverse cuts 22 which is shown by the dotted lines.

In order to form the marker tail 13 the anchor sheet 45 is cut along transverse cut 24 which extends about $\frac{3}{4}$ of the way across the associated side of the blank of an anchor 10, and cut along longitudinal cut 23 which extends between the transverse cuts 24 and 22. Transverse cut 24 extends through to fold line 16 thus forming the two leaves 15 and 14 of the marker tail 13.

Once an anchor 10 is formed by blanking from the sheets 45, 48 as described, the marker 17 is secured to the anchor by simply folding the marker tail 13 at the fold line 16 and catching both faces of the marker 17 in the pressure sensitive adhesive 8. It is preferable that the width of the marker tail 13 is more than twice the width of the marker 17 so that the pressure sensitive adhesive 8 on leaf 15 interacts with the pressure sensitive adhesive on leaf 14 and ensures that the folded tail 13 will not let go of the marker 17.

It can be seen that the marginal zone occupied by the marker tail 13 and a small waste rectangle 49 of anchor sheet 45, is superposed by the release tab 19 of the backing 18 of an adjacent anchor. This superposition enables the efficient manufacture of the bookmark 5 with a relatively small degree of waste.

The anchor sheet 45 and the corresponding backing sheet material 48 may be provided in large sheets or rolls and then cut as shown. After blanking and separation from the sheet stock only one step, the step of folding the marker tail 13 over the marker 17 is required to complete the assembly of the body and marker.

Figure 4:
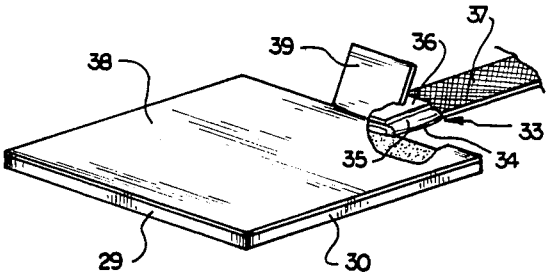
FIG. 4 is a perspective view of another embodiment of the invention.

Other embodiments of this invention may be used, as for example shown in FIG. 4. Here a marker tail 33 includes three leaves, a central leaf 34 integrally joined to an anchor body 29 and two leaves 35, 36, severed from the body, but each integrally joined on each side of the central leaf 34 and each lapping around a marker 37. A release tab 39 on the same side of the anchor body 29 as the tail 33, extends underneath the tail 33. In this embodiment, the release tab portion of the backing sheet is donated by the underlying marker tail of the same anchor. Again, for convenience and reduced waste, the release tab 39 and marker tail 33 have the same height.

From the foregoing it will be understood that the bookmark may be of various material and shapes. Accordingly, the forms of the invention described herein should be considered as illustrative and the invention should not be considered as limited except as defined in the following claims.

What is claimed is:

1. A bookmark to be manually secured to a cover of a book by a user comprised of:

flat anchor sheet means having a front face and a back face, the back face being treated with pressure sensitive adhesive, and having an integral marker tail which extends for a length from the anchor sheet means and which is similarly treated with said pressure sensitive adhesive;

a release back sheet which releasably adheres to the pressure sensitive adhesive of the anchor sheet means and is removed before the bookmark is secured to the book, said release back sheet is removable by peeling said release back sheet from the anchor sheet means for purposes of affixing the anchor sheet means to a book with the pressure sensitive adhesive;

the release back sheet including a release tab extending integrally for a length from the release back sheet, said release tab being free of the anchor sheet means and having a free length corresponding to the length of the extension of the marker tail from the anchor sheet means; and elongate, flexible marker means secured adjacent one end thereof to the pressure sensitive adhesive of the marker tail, said marker means being adapted to be placed between the pages of the book;

the release tab originally being releasably adhered to said marker tail and, when separated from said marker tail, allows the pressure sensitive adhesive of said marker tail to secure said elongate marker means and said tab functions as a free element for grasping and peeling said release back sheet from said anchor sheet means.

2. A bookmark as in claim 1 wherein the marker means is a flat element having a front face and a back face; said marker means being held to the marker tail on both faces.

3. A bookmark as in claim 1 wherein the marker means has a front face and a back face, the marker tail having two leaves, a first leaf extending integrally from the anchor sheet means, the second leaf extending integrally from the first leaf and being separate from the anchor sheet means, both leaves being treated with pressure sensitive adhesive; the marker means being secured to the marker tail in a manner whereby one leaf adhesively secures one face of the marker means, and the other leaf adhesively secures the other face of the marker means.

4. A bookmark as set forth in claim 1, wherein the marker tail has leaves and is connected to the anchor sheet means by a first leaf, the first leaf being a continuous integral extension of the anchor sheet means, a second leaf being adjacent to but not connected to the anchor sheet means, the boundary between the first leaf and the second leaf forming a fold line, and the first and second leaves being treated with said pressure sensitive adhesive; and the marker means has a front face and back face, the marker means being secured to the marker tail in a manner whereby one leaf adhesively secures one face of the marker means and the other leaf adhesively secures the other face of the marker means, the marker means being secured to said marker tail in a manner in which the longitudinal axis of said marker means is parallel to the fold line of said marker tail.

5. A bookmark as set forth in claim 4, wherein the width of the marker tail is more than twice the width of the marker means so that the pressure sensitive adhesive on the first leaf interacts with the pressure sensitive adhesive on the second leaf.

6. A bookmark to be manually secured to a cover of a book by a user comprised of:

flat anchor sheet means having a front face and a back face, the back face being treated with pressure sensitive adhesive, and having an integral marker tail which extends for a length from the anchor sheet means and which is similarly treated with said pressure sensitive adhesive;

a release back sheet which releasably adheres to the pressure sensitive adhesive of the anchor sheet means and is removed before the bookmark is secured to the book, said release back sheet being removable by peeling said release back sheet from the anchor sheet means for purposes of affixing the anchor sheet means to a book with the pressure sensitive adhesive;

the flat anchor sheet means and release back sheet being blanked from laminated composite sheet stock;

the release back sheet including a release tab extending integrally for a length from the release back sheet, said release tab being free of the anchor sheet means and having a free length corresponding to the length of the extension of the marker tail from the anchor sheet means; and elongate, flexible marker means secured adjacent one end thereof to the pressure sensitive adhesive of the marker tail, said marker means being adapted to be placed between the pages of the book;

the release tab originally being releaseably adhered to a marker tail of an adjacent book mark blanked from said laminated composite sheet stock and, when separated from said adjacent marker tail, allows the pressure sensitive adhesive of said adjacent bookmark marker tail to secure an elongate marker means and said tab functions as a free element for grasping and peeling said release back sheet from said anchor sheet means.

* * * * *